US005915600A

United States Patent [19]

Bitton

[11] Patent Number: 5,915,600

[45] Date of Patent: Jun. 29, 1999

[54] SUCTION TUBE MOUNT FOR ORNAMENTS WITHIN A CONTAINER

[76] Inventor: Mary Kay Bitton, 467 Burano Ct., Agoura, Calif. 91301

[21] Appl. No.: 08/944,065

[22] Filed: Oct. 2, 1997

[51] Int. Cl.[6] ..... B67D 5/60; B67D 13/00; A47G 21/18; B05B 1/00

[52] U.S. Cl. ..... 222/464.1; 222/321.8; 222/78; 239/33; 239/211

[58] Field of Search ..... 222/321.8, 464.1, 222/78; 239/33, 211; D7/300.2, 300

[56] References Cited

U.S. PATENT DOCUMENTS

| | | | |
|---|---|---|---|
| D. 334,503 | 4/1993 | Neuber, Sr. | D7/300.2 |
| D. 392,148 | 3/1998 | Lewis | D7/300.2 |
| 1,916,646 | 7/1933 | Tycko | 239/33 |
| 2,619,770 | 12/1952 | Dinhofer | 239/33 |
| 3,134,505 | 5/1964 | Modderno | 222/82 |

FOREIGN PATENT DOCUMENTS

| | | | |
|---|---|---|---|
| 15442 | 7/1911 | United Kingdom | 239/33 |

*Primary Examiner*—Andres Kashnikow
*Assistant Examiner*—Kents Quinalty
*Attorney, Agent, or Firm*—Crockett & Fish; K. David Crockett, Esq.

[57] ABSTRACT

A pump, spray or suction actuated dispenser with a suction tube extending into a container, wherein the suction tube is used to mount an ornamental figure.

1 Claim, 2 Drawing Sheets

SUCTION TUBE MOUNT FOR ORNAMENTS WITHIN A CONTAINER

FIELD OF THE INVENTION

This invention relates to devices for mounting structures and ornaments within containers.

BACKGROUND OF THE INVENTION

Bottles and jars are made with various ornamental features. The ornaments usually consist of the shape of the bottle, and artwork applied to the surface of the bottle. Liquid soap is now sold in clear plastic bottles with artwork on plastic sheets within the bottles. In an unrelated art, figurines with receiving bores are sold as pencil toppers.

SUMMARY

The present invention provides a means for mounting three dimensional art or two dimensional art within a bottle so that it is visible from the outside of the bottle. The three dimensional artwork is provided in the form of a small figurine of an animal, person, cartoon character, action figures or other attractive representation. The figurine is provided with a receiving bore or clip with which it is attached to the suction tube used in many pump or spray assemblies.

The ornamental figure inside the pump bottle can be used to provide interest amusement to children using the soap, as an advertising medium and tie-in for commercial exploitation of characters, as a promotional item for various events, as a trademark or tradedress, or merely as a novelty item for many different purposes.

DETAILED DESCRIPTION OF THE INVENTION

Figure 1:
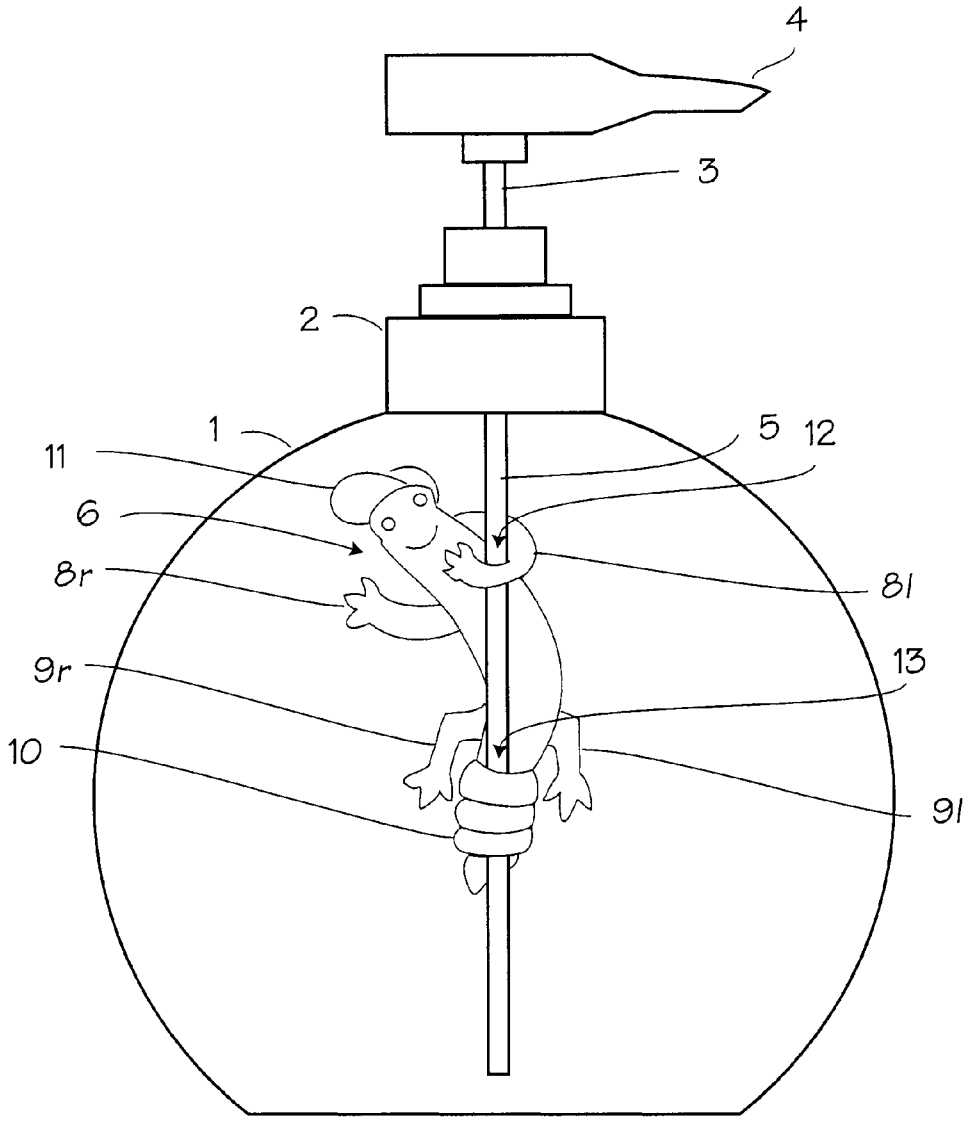
FIG. 1 is an front view of a pump dispenser fitted with an ornamental figure on the suction tube.

FIG. 1 shows a front view of a bottle with a pump dispenser typical of those used for liquid soaps. The bottle 1 is provided with a cap 2, a pump piston 3 and a dispensing tip 4. The suction tube 5 is connected to the pump piston and dispensing tip in any suitable manner known in the art. The suction tube 5 typically extends downward to the bottom of the bottle, and may be extra long so that it must bend to fit into the bottle. The suction tube is universally provided as a round or cylindrical tube, although it might have many different cross sections. The dispensing tip may be a dropper dispenser for use with viscous materials such as liquid soap or Softsoap®, or it may be a spray dispenser for free flowing liquids such as perfume, hair spray, or window cleaner, or it may be a sipping tube for beverages (in which case an intermediate pump mechanism is not used).

The ornamental FIG. 6 in FIG. 1 may be made in any form, representing any character, animal or thing. In this case, the ornamental FIG. 6 is a whimsical representation of a newt or salamander, with a body 7, arms 8l and 8r, legs 9l and 9r, a tail 10, and a silly baseball cap 11. The ornamental FIG. 6 is fabricated in any suitable manner. As can be seen in FIG. 1, the ornamental FIG. 6 is attached to the suction tube 5. To accomplish this attachment, the ornamental FIG. 6 is provided with one or more receiving bores 12 and 13.

The receiving bores are lengths of cylindrical cavities formed within the ornamental figure. The receiving bore 12 is formed through the figure between the body 7 and the left arm 8l, to make it appear as though the newt is grasping the suction tube. The receiving bore 13 is formed through the tail 10, which is coiled to appear as though the newt is grasping the suction tube with his tail. It should be appreciated that the receiving bore need not completely encircle the suction tube, and any number of receiving bores may be used. The receiving bore inner diameter may be closely matched to the outer diameter so as to form a friction fit between the suction tube and the ornamental figure that prevents or inhibits movement of the figurine along the suction tube. Alternatively, the receiving bore inner diameter may be loosely matched to the outer diameter so as to form a loose slidable fit between the suction tube and the ornamental figure that allows movement of the figurine along the suction tube. When sliding is permitted, the figure may be made in appropriate density to float (density less than the solution in the bottle). For example, if the fluid is water with a density of 1.0, the figurine will float if made with a density less than 1.0. The figurines will float submerged if its density is approximately equal to 1.0, and it will sink it the density is greater than 1.0. Thus the figurine made with a loosely fitting bore may be made in the appropriate density depending on whether it is desired to have the figurine float, float submerged, or sink along the suction tube.

The ornamental figure may be placed inside the container either before or during manufacture. Where the figurine is smaller than the container neck, it may simply be loaded onto the suction tube and inserted into the bottle when the cap and pump assembly is screwed onto the bottle neck. Figurines larger than the bottle neck may be installed inside the bottle during manufacture of the bottle.

Figure 2:
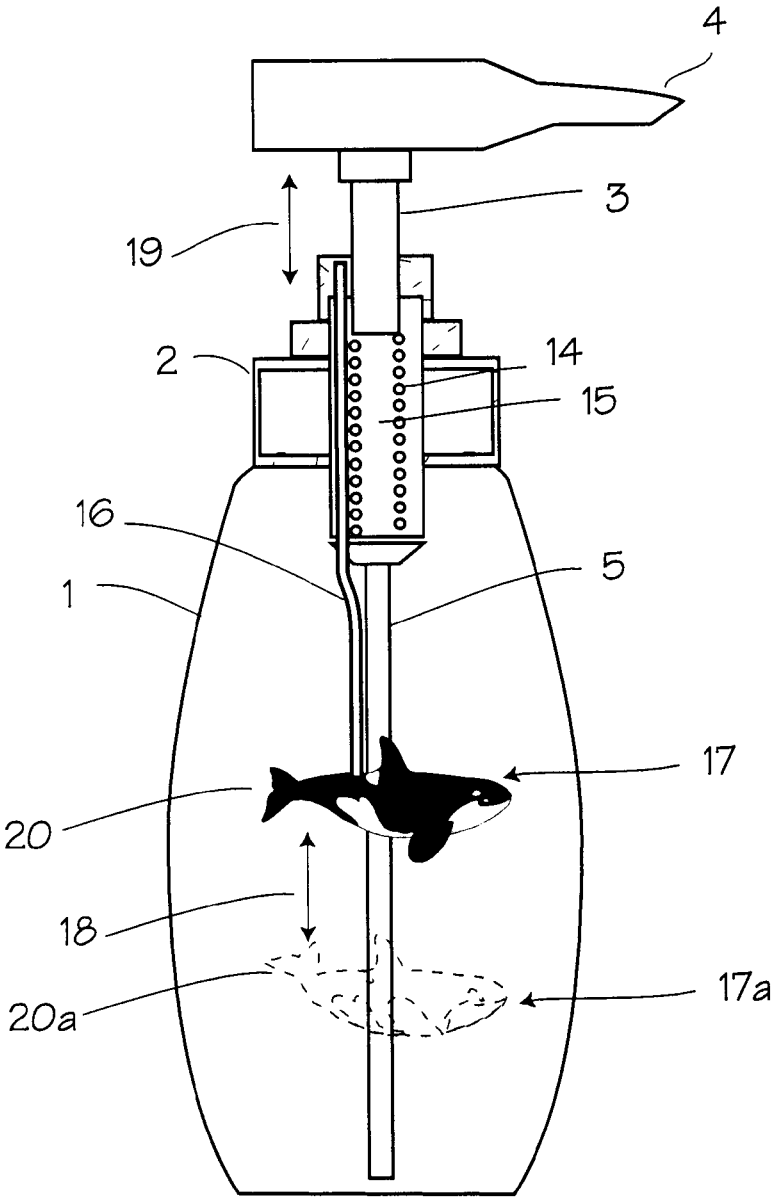
FIG. 2 is a front view of a pump dispenser fitted with an ornamental figure slidably mounted on the suction tube

FIG. 2 shows an embodiment in which the ornamental figurine is mounted on the suction tube in a sliciable manner, and is connected to the pump mechanism so that actuation of the pump causes movement of the ornamental figure. The pump internal mechanisms typically include an actuator previously referred to as the pump piston 3. The pump piston is forced downward by the person using the dispenser, and is forced upward by spring 14. (On the downward stroke, any fluid in the chamber 15 is forced out the dispenser tip, and on the upward stroke fluid is drawn into the chamber from the container.) An actuating rod 16 is fixed to the pump piston 3 and routed through the screw cap 11 and attached to the slidably mounted ornamental figure 17. The ornamental figure, if slidably mounted on the section tube, will move up and down with the pump piston, as indicated by arrows 18 (indicating movement of the whale) and 19 (indicating movement of the piston). The figurine may be made of a very floppy material which wiggles and bends when moved through the liquid in the container. For example, in FIG. 2 the figure depicted is a whale, and its tail 20 is made of very soft and floppy material which bends as the whale is forced up and down in the fluid, giving the appearance that the whale is wagging its tail. In similar manner, many variations of figurines can be provided with flow-movable parts. The figurine might be a representation of Batman, for example, with a cape made of fabric or flimsy polypropylene (baggie plastic) which flaps during movement in the liquid.

The figurine may also be provided with a small mechanical linkage for moving parts within the figurine, and it may be fixed at a position on the suction tube (not slidably mounted) so that pump actuation via the actuating rod 16 causes action or movement of specific parts of the figurine. Such figurines are commonplace in the toy art.

The suction tube mounted ornament may be used in sipper cups, soap dispensers, bubble bath dispensers, shampoo bottles, tooth paste pumps, sport bottles, perfume bottles, and bottles, jars, cups and containers of all descriptions. The figurine may comprise artistic representations of many figures and characters, including action figures, sports figures, cartoon characters, children's characters (Sesame Street characters, Barney, fairy tale characters), seasonal characters and many more.

While the preferred embodiments of the devices and methods have been described in reference to he environment in which they were developed, they are merely illustrative of the principles of the inventions. Other embodiments and configurations may be devised without departing from the spirit of the inventions and the scope of the appended claims.

I claim:

1. A fluid dispenser comprising a container, a suction tube and a dispensing tip, further comprising:

an ornamental figure within the container, said ornamental figure having a receiving bore sized and dimensioned to receive the suction tube within the receiving bore, said figure being mounted on the suction tube by insertion of the suction tube into the receiving bores;

a pump mechanism secured to the container, said pump mechanism being in fluid communication with the suction tube;

said suction tube being disposed within the container; said container being comprised of a transparent material.

* * * * *